United States Patent [19]

Tatsumi

[11] 4,393,771

[45] Jul. 19, 1983

[54] PRINTING HEAD FOR A PRINTER

[75] Inventor: Juichi Tatsumi, Iruma, Japan

[73] Assignee: Ye Data Inc., Tokyo, Japan

[21] Appl. No.: 324,637

[22] Filed: Nov. 24, 1981

[30] Foreign Application Priority Data

Nov. 25, 1980 [JP] Japan ..... 55-167504[U]

[51] Int. Cl.[3] ..... B41J 9/02

[52] U.S. Cl. ..... 101/93.48; 101/93.04; 400/124; 335/128

[58] Field of Search ..... 101/93.04, 93.48; 100/121, 124; 335/187, 271, 128

[56] References Cited

U.S. PATENT DOCUMENTS 3,090,297 5/1963 Wilkins et al. ..... 101/93.33 X 3,828,908 8/1974 Schneider ..... 400/124

4,244,658 1/1981 Mori ..... 400/124

*Primary Examiner*—Clifford D. Crowder

*Attorney, Agent, or Firm*—Wenderoth, Lind & Ponack

[57] ABSTRACT

A permanent magnet type printing head for an impact dot printer wherein a plate spring hammer has a hammer tip provided on one side thereof, and an attracting magnetic pole provided with a releasing electromagnetic coil arranged on the side opposite said hammer, wherein an armature is provided on the upper surface of the plate spring hammer instead of providing same on the same side of a magnetic pole, and wherein an arm of a yoke constituting a main magnetic path is provided on the plate spring hammer, and the magnetic pole is positioned between the hammer tip and the armature.

2 Claims, 4 Drawing Figures

PRINTING HEAD FOR A PRINTER

BACKGROUND OF THE INVENTION

1. Field of the Invention

The present invention relates to a permanent magnet type printing head for an impact dot printer.

2. Description of the Prior Art

In prior art systems, a printing head as shown in FIG. 1 is generally used, wherein yokes 2 and 3 are respectively mounted on and beneath a permanent magnet 1, one yoke 2 being provided with a plate spring hammer 5 having a hammer tip 4 disposed on the upper surface of the extreme end thereof, the other yoke 3 being provided with a magnetic pole 7 having a releasing electromagnetic coil 6 wound thereon, whereby during waiting, the hammer 5 is attracted by the permanent magnet as shown and during printing, the electromagnetic coil 6 is energized to release the hammer 5.

In the aforementioned prior art printing head, however, since the plate spring constituting the hammer 5 comprises a magnetic path, the plate spring cannot be greatly reduced in thickness, and thus, the inertia of the hammer 5 is inevitably high, thereby failing to provide a high speed operation.

An improved printing head as shown in FIG. 2 has been proposed in which, an arm 2*a* is provided with a through hole 8 between the hammer 5 and the magnetic pole 7 and is extended from the upper yoke 2, and the hammer 5 has an armature 9 which is movable within the through hole 8 through a small clearance a.

In the aforementioned improved printing head, a main magnetic flux of the permanent magnet 1 flows from the yoke 2 into the magnetic pole 7 through the small clearance a and armature 9, and the plate spring hammer 5 does not comprise the main magnetic path. Thus, the plate spring hammer 5 may be reduced in thickness and therefore, the inertia of the hammer 5 can be decreased to thereby render the high speed operation possible.

However, the printing head of this type has the following disadvantages:

(1) Large amount of wear in the armature 9 and in the head of the magnetic pole In the printing head of this type, the armature 9 hits the magnetic pole 7 as a result of the primary vibration (vertical vibration) of the plate spring hammer 5 during the printing operation, and in addition, a lateral oscillation movement of the bottom surface of the armature 9 occurs as a result of the secondary vibration (vertical vibration of the hammer tip portion) due to the mass of the hammer tip portion after the attraction of the armature to the pole; the secondary vibration causes friction of the upper surface of the magnetic pole, the amount of wear of which is not regligible.

(2) Dimensional precision of the armature 9 is hard to obtain, resulting in a higher cost.

For printing heads having a number of aligned hammers, such as printers for Chinese characters, it is necessary to make constant the flexture amount of the plate spring (hammer 5) during waiting and the stroke of the hammer during printing, in order to provide for printing at high speeds and in a stabilized fashion. That is, the hammer used must be constant in height from the fixed surface of the hammer to the bottom surface of the armature and in height from the bottom surface of the armature to the extreme end of the hammer tip, and thus considerable care must be taken to the management of the dimensions in terms of the manufacture of the printing head, resulting in a higher cost.

SUMMARY OF THE INVENTION

It is a primary object of the present invention to provide a permanent magnet type printing head which can be operated at high speed.

It is a further object of the present invention to provide a permanent magnet type printing head which can minimize the wear in the upper surface of the magnetic pole and the shock associated therewith during operation.

It is another object of the present invention to provide a permanent magnet type printing head which can be made available at a low cost.

DESCRIPTION OF THE PREFERRED EMBODIMENT

Figure 1:
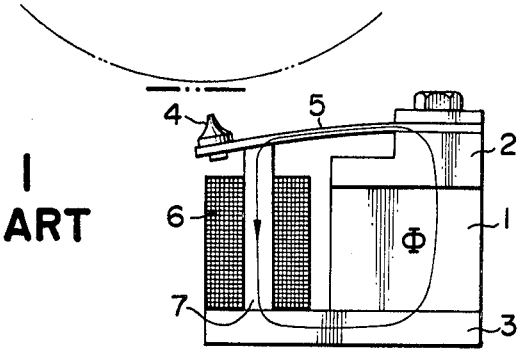
FIG. 1 PRIOR ART
FIGS. 1 and 2 are respectively side views of prior art printing heads.
Figure 3:
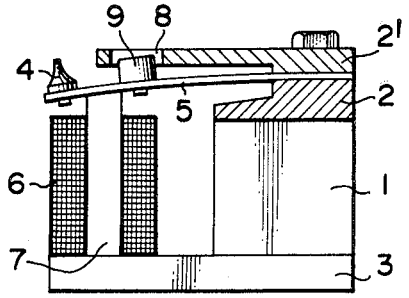
FIG. 3 is a partly cutaway side view of the embodiment in accordance with the present invention.

FIG. 3 shows one embodiment in accordance with the present invention. Similarly to the prior art shown in FIG. 1, Yokes 2 and 3 are respectively mounted on and beneath a permanent magnet 1, one yoke 2 being provided with a plate spring hammer 5 having a hammer tip 4 disposed on the upper surface of the extreme end thereof, the other yoke 3 being provided with a magnetic pole 7 having a releasing electromagnetic coil 6 wound thereon; an armature 9 is provided on the upper surface of the hammer 5 on the side where the hammer 5 is fixed and at a position closest to the magnetic pole 7, and a yoke 2' having a through hole 8 within which the armature 9 is movable through a small clearance is provided on the hammer 5.

Figure 2:
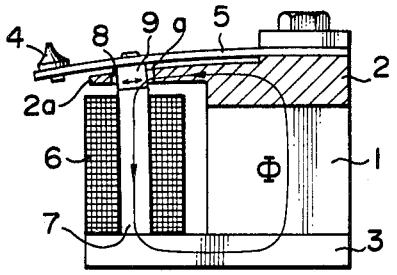
FIG. 2 PRIOR ART

The printing head in accordance with the present invention has a magnetic flux passage comprising a line of the permanent magnet 1—yoke 2—base of the plate spring hammer 5—yoke 2'—armature 9—part of the plate spring hammer—magnetic pole 7—yoke 3—permanent magnet 1, and since the magnetic path of the plate spring hammer portion is extremely short in length, the plate spring may be reached in thickness, thus making it possible to obtain a high speed performance similar to the prior art embodiment shown in FIG. 2.

Also, as for the wear, it is possible to sufficiently decrease the amount of wear as described hereinafter.

An end of the secondary vibration between the hammer tip 4 and the armature 9 is effected, that is, the secondary vibration within the contact surface between the armature and the magnetic pole 7 is ended, so as to thereby sufficiently decrease the amount of wear; the contact surface does not have the lateral movement as in the embodiment shown in FIG. 2 but merely has up and down movement so as to contact pole 7.

Since the portion which impinges upon the magnetic pole 7 is a spring, the impact can be comparatively reduced as compared to the prior art shown in FIG. 2, in which the armature directly impinges thereupon.

Furthermore, since the management in dimensions of the hammer is simple in terms of its manufacture, the device may be manufactured at a low cost, which is suitable in construction for a printing head for an impact dot printer.

Figure 4:
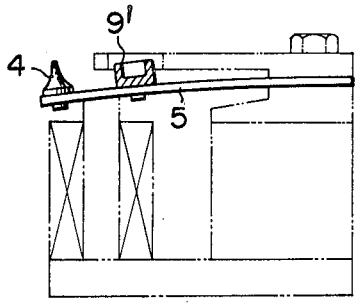
FIG. 4 is a partially cutaway side view of a different form of an embodiment of the present invention.

FIG. 4 shows a different embodiment in which an armature 9′ is cup-shaped, which can reduce the mass of the armature without increasing its magnetic resistance and can thereby operate at much higher speed than that of the aforementioned embodiment of FIG. 3.

I claim:

1. In permanent magnet type printing head for an impact dot printer wherein a plate spring hammer has a hammer tip provided on one side thereof, and an attracting magnetic pole provided with a releasing electromagnetic coil arranged on another side opposite said hammer, the improvement comprising an armature disposed on the side where said hammer tip of said plate spring hammer is provided, and a yoke formed with a through hole or notch within which said armature is movable, said attracting magnetic pole being arranged between said hammer tip and said armature.

2. A printing head for a printer according to claim 1, wherein the armature is in the form of a cup.

* * * * *